United States Patent [19]

Hiraga et al.

[11] Patent Number: 4,548,555

[45] Date of Patent: Oct. 22, 1985

[54] SCROLL TYPE FLUID DISPLACEMENT APPARATUS WITH NONUNIFORM SCROLL HEIGHT

[75] Inventors: Masaharu Hiraga, Honjo; Yuji Yoshii, Takasaki, both of Japan

[73] Assignee: Sanden Corporation, Gunma, Japan

[21] Appl. No.: 450,860

[22] Filed: Oct. 11, 1983

[30] Foreign Application Priority Data

Sep. 10, 1982 [JP] Japan ..... 57-176989

[51] Int. Cl.[4] ..... F01C 1/04; F01C 21/08

[52] U.S. Cl. ..... 418/55

[58] Field of Search ..... 418/55, 57, 83, 142, 418/182

[56] References Cited

U.S. PATENT DOCUMENTS 4,457,674 7/1984 Kawano et al. ..... 418/55

FOREIGN PATENT DOCUMENTS 54-157315 12/1979 Japan ..... 418/55

*Primary Examiner*—John J. Vrablik

*Attorney, Agent, or Firm*—Banner, Birch, McKie & Beckett

[57] ABSTRACT

A scroll type fluid displacement apparatus including a housing and a pair of scrolls having interfitting spiral wraps which undergo relative orbital motion to make moving line contacts and define sealed off moving fluid pockets of changing volume. The center portion of at least one of the wraps is higher than the remaining portion thereof. The center portion extends substantially from the inner end of the spiral wrap outwardly at least to the location of the line contact between the curved surfaces of the wraps when the innermost pair of fluid pockets are merged into a single fluid pocket to form the high pressure space near the center of the scrolls. This construction prevents abnormal wear of the spiral wrap and the opposite end plate which might otherwise occur during axial slant of the orbiting scroll, or which might be caused by non-parallelism of the scroll end plates, without compromising the important sealing of the central high pressure space.

3 Claims, 9 Drawing Figures

SCROLL TYPE FLUID DISPLACEMENT APPARATUS WITH NONUNIFORM SCROLL HEIGHT

BACKGROUND OF THE INVENTION

This invention relates to a fluid displacement apparatus of the scroll type, such as a compressor, expander or pump.

Scroll type fluid displacement apparatus are well-known in the prior art. For example, U.S. Pat. No. 801,182 discloses a scroll type apparatus including two scroll members, each having a circular end plate and a spiroidal or involute spiral element. These scroll members are maintained at an angular and a radial offset so that the spiral elements interfit to make a plurality of line contacts between their spiral curved surfaces, to thereby seal off and define, along with moving axial contacts between spiral end surfaces and scroll end plates, at least one pair of fluid pockets. The relative orbital motion of the two scroll members shifts the line contacts along the spiral curved surfaces and, therefore, the fluid pockets change in volume. The volume of the fluid pockets increases or decreases, depending on the direction of the orbiting motion. Therefore, the scroll type fluid displacement apparatus is applicable to compress, expand or pump fluids.

The principles of operation of a typical scroll type compressor will be described with reference to FIGS. 1*a*–1*d*. FIGS. 1*a*–1*d* schematically illustrate the relative movement of interfitting spiral elements to compress the fluid, and may be considered as end views of the compressor wherein the end plates are removed and only the spiral elements are shown.

Two spiral elements 1 and 2 are angularly and radially offset and interfit with one another. As shown in FIG. 1*a*, the orbiting spiral element 1 and fixed spiral element 2 make four line contacts as shown at four points A-D. A pair of fluid pockets 3*a*, and 3*b* are defined between line contacts D-C and line contacts A-B as shown by the dotted regions. The fluid pockets 3*a* and 3*b* are defined not only by the curved walls of spiral elements 1 and 2 but also by the end plates from which these spiral elements extend. When orbiting spiral element 1 is moved in relation to fixed spiral element 2 so that the center 0' of orbiting spiral element 1 revolves around the center 0 of fixed spiral element 2 with a radius 0—0', while the rotation of orbiting spiral element 1 is prevented, the fluid pockets 3*a* and 3*b* shift angularly towards the center of the interfitting spiral elements with the volume of each fluid pocket 3*a* and 3*b* being gradually reduced, as shown in FIGS. 1*a*–1*d*. Therefore, the fluid in each pocket is compressed.

Pockets 3*a* and 3*b* are connected to one another after reaching the stage illustrated in FIG. 1*d* and, as shown in FIG. 1*a*, pockets 3*a* and 3*b* merge at the center portion 5 and are completely connected to one another to form a single, high pressure central pocket. The volume of the connected single pocket is further reduced by further revolutions of 90°, as shown in FIGS. 1*b*, 1*c* and 1*d*. During the course of revolution, outer spaces which open in the state shown in FIG. 1*b* change as shown in FIGS. 1*c*, 1*d* and 1*a*, to form new sealed off pockets in which fluid is newly enclosed.

Accordingly, if circular end plates are disposed on, and sealed to, the axial facing ends of spiral elements 1 and 2, respectively, and if one of the end plates is provided with a discharge port 4 at the center thereof, as shown in the figures, fluid is taken into the fluid pockets at the radially outer portion and is discharged through the discharge port 4 after compression.

As mentioned above, in the scroll type compressor the fluid is compressed by a change in the volume of the fluid pocket due to orbital motion of the orbiting scroll. The fluid pocket is defined by the line contacts between the curved surfaces of the spiral elements, and the axial contact between the end surfaces of the circular end plates and the axial end surfaces of the spiral elements, the line contacts shifting along the spiral curved surfaces due to the orbital motion. Radial sealing at the line contacts is insured by the use of a compliant drive mechanism, which allows the orbiting scroll to deviate slightly from a perfectly circular orbit so that its spiral element can closely follow the curved surface of the fixed spiral element even if these curved surfaces have dimensional errors. Effective sealing is essential to high volumetric efficiency, especially in the case of the central high pressure space (defined by the line contacts between the spiral surfaces when the two innermost fluid pockets just merge into a single pocket: FIGS. 1*d* to 1*a*).

The scroll type fluid displacement apparatus is well-suited for use as the refrigerant compressor of an automobile air conditioner. Generally, it is desirable that the compressor should be compact and light in weight. In particular, the refrigerant compressor for an automobile air conditioner must be compact in size and light in weight because the compressor must fit in the often cramped engine compartment of the automobile. Of course, if the diameter of the compressor is reduced to achieve compactness, the diameter of the circular end plates of the scrolls correspondingly must be reduced as much as possible. In this situation, however, at some portion of the orbital path of the orbiting scroll, the outer terminal end portion of the fixed spiral element will lose axial contact with the surface of the small end plate of the orbiting scroll. Therefore, abnormal wear of the fixed spiral element and the end plate of the orbiting scroll is caused by edgewise interference therebetween. This condition is aggravated when the compliantly driven orbiting scroll is subjected to axial slant, such as often occurs during start-up and shut-down of the compressor. Edgewise interference leading to abnormal wear may also be aggravated when the parallel condition of the end plates is not maintained over the entire swept area of each end plate. In order to avoid this situation, manufacturing tolerances must be kept very close, yielding a costly compressor.

SUMMARY OF THE INVENTION

It is a primary object of this invention to provide an efficient scroll type fluid displacement apparatus.

It is another object of this invention to provide a scroll type fluid displacement apparatus wherein the line contacts between the two spiral elements and the axial contacts between the end plates and the spiral elements are insured in order to seal the high pressure space.

It is still another object of this invention to realize the above objects with a simple construction, a simple production method and low cost.

A scroll type fluid displacement apparatus according to this invention includes a housing and a pair of scroll members therein. One of the scroll members is fixedly disposed relative to the housing and has an end plate from which a first spiral wrap extends into the interior of the housing. The other scroll member is movably disposed for non-rotative orbital movement within the interior of the housing and has an end plate from which a second spiral wrap extends. The first and second wraps interfit at an angular and a radial offset to make a plurality of line contacts to define at least one pair of sealed off fluid pockets. A driving and rotation-preventing mechanism is operatively connected to the other scroll member to effect the orbital motion thereof while preventing its rotation, thus causing the fluid pockets to change in volume. The two innermost pockets eventually are merged into a single pocket near the center of the wrap. The center portion of at least one of the wraps is higher than the remaining portion thereof. The center portion extends substantially from the inner end of the wrap outwardly at least to the location of the line contact between the spiral curved surface when the two innermost fluid pockets are merged into a single fluid pocket. Sealing of the central high pressure space which is formed at the centers of the wraps is therefore maintained, and abnormal wear of the spiral elements and the end plates which occurs during axial slant of the orbiting scroll is prevented.

Further objects, features and other aspects of this invention will be understood from the following detailed description of the preferred embodiments of this invention in conjunction with the annexed drawings.

DETAILED DESCRIPTION OF THE PREFERRED EMBODIMENTS

Figure 1A:
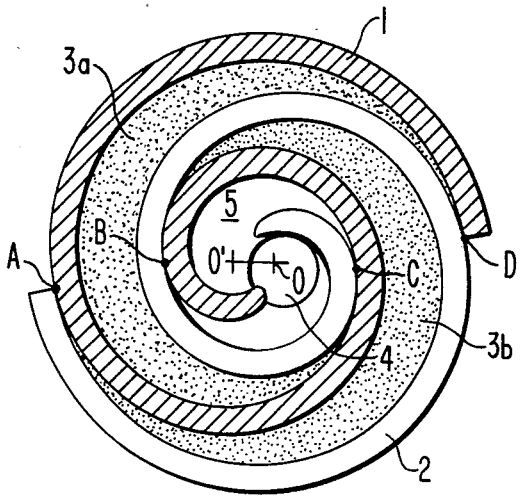
FIGS. 1*a*–1*d* are schematic views illustrating the relative movement of interfitting spiral elements to compress the fluid in a scroll type compressor.
Figure 1C:
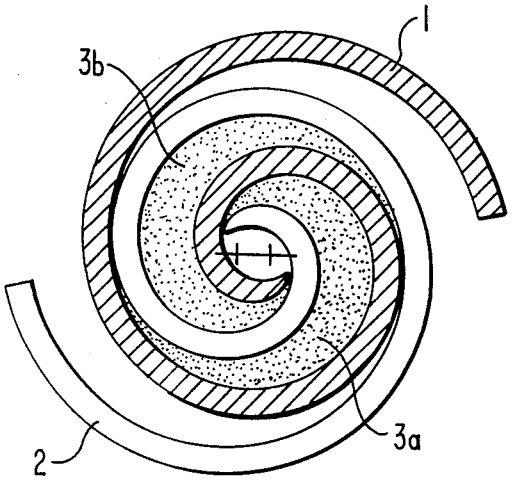
Figure 1B:
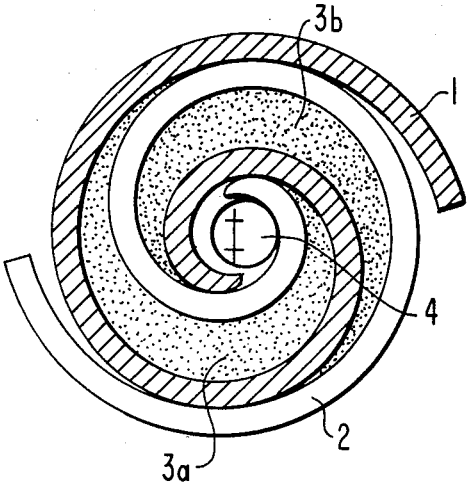
Figure 1D:
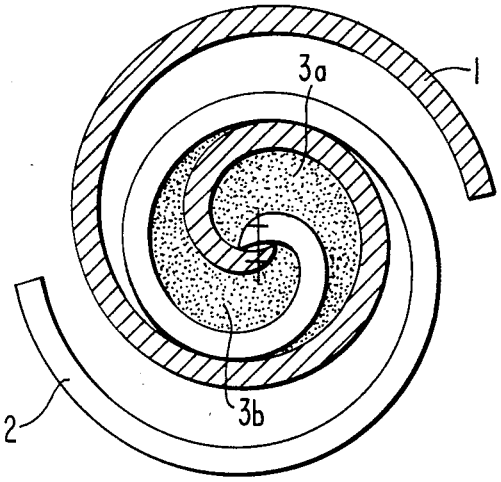
Figure 2:
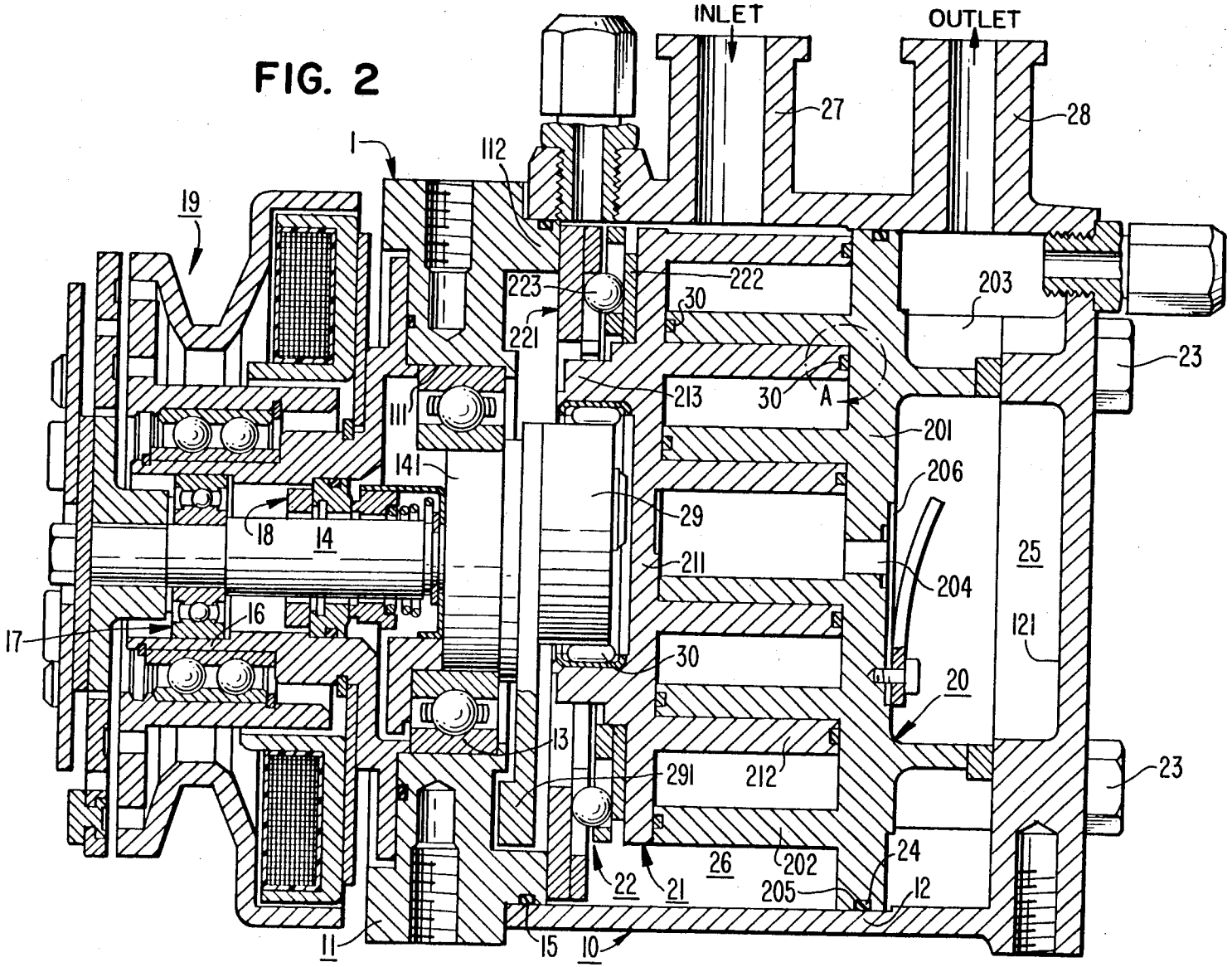
FIG. 2 is a vertical sectional view of a compressor according to the invention.
Figure 2A:
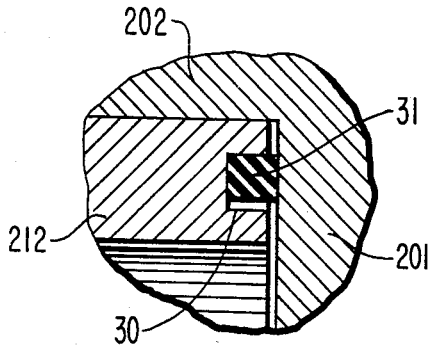
FIG. 2*a* is an enlarged view of encircled area A in FIG. 2.

Referring to FIG. 2, a refrigerant compressor unit 1 in accordance with the present invention is shown. The unit includes a compressor housing 10 comprising a front end plate 11 and a cup-shaped casing 12 attached to one side surface of front end plate 11. An opening 111 is formed in the center of front end plate 11 for penetration or passage of a drive shaft 14. An annular projection 112, concentric with opening 111, is formed on the inside face of front end plate 11 and projects towards cup-shaped casing 12. An outer peripheral surface of annular projection 112 contacts the inner wall surface of cup-shaped casing 12. An O-ring member 15 is placed between front end plate 11 and the open portion of cup-shaped casing 12, to thereby secure a seal between the fitting or mating surfaces of the front end plate 11 and cup-shaped casing 12. Cup-shaped casing 12 is fixed to front end plate 11 by fastening means, such as bolts and nuts (not shown). The open portion of cup-shaped casing 12 is thereby covered, closed and sealed by front end plate 11.

Front end plate 11 has an annular sleeve portion 16 projecting outwardly from the front or outside surface thereof. Sleeve 16 surrounds drive shaft 14 and defines a shaft seal cavity. In the embodiment shown in FIG. 2, sleeve portion 16 is formed separately from front end plate 11. Therefore, sleeve portion 16 is fixed to the front end surface of front end plate 11 by fastening means, such as screws (not shown). Alternatively, sleeve portion 16 may be formed integral with front end plate 11.

Drive shaft 14 is rotatably supported by sleeve portion 16 through a bearing 17 disposed within the front end portion of sleeve portion 16. Drive shaft 14 is formed with a disk rotor 141 at its inner end portion, which is rotatably supported by front end plate 11 through a bearing 13 disposed within opening 111. A shaft seal assembly 18 is assembled on drive shaft 14 within the shaft seal cavity of front end plate 11.

Drive shaft 14 is coupled to an electromagnetic clutch 19 which is disposed on the outer portion of sleeve portion 16. Thus, drive shaft 14 is driven by an external drive power source, for example, the motor of a vehicle, through electromagnetic clutch 19.

A fixed scroll 20, an orbiting scroll 21, a driving mechanism for orbiting scroll 21 and a rotation preventing/thrust bearing device 22 for orbiting scroll 21 are disposed in the inner chamber of cup-shaped casing 12. The inner chamber is formed between the inner wall of cup-shaped casing 12 and front end plate 11.

Fixed scroll 20 includes a circular end plate 201 and a wrap or involute spiral element 202 fixed to and extending from one major side surface of circular end plate 201. Circular end plate 201 is formed with a plurality of legs 203 axially projecting from its other major side surface as shown in FIG. 2. An axial end surface of each leg 203 is fitted against the inner surface of a bottom plate portion 121 of cup-shaped casing 12 and fixed by screws 23 which screw into legs 203 from the outside of bottom plate portion 121. A groove 205 is formed on the outer peripheral surface of circular end plate 201, and a seal ring member 24 is disposed therein to form a seal between the inner surface of cup-shaped casing 12 and the outer peripheral surface of circular end plate 201. Thus, the inner chamber of cup-shaped casing 12 is partitioned into two chambers by circular end plate 201: a rear or discharge chamber 25, in which legs 203 are disposed, and a front or suction chamber 26, in which spiral element 202 of fixed scroll 20 is disposed.

Cup-shaped casing 12 is provided with a fluid inlet port 27 and a fluid outlet port 28, which respectively are connected to the front and rear chambers 26 and 25. A hole or discharge port 204 is formed through circular end plate 201 at a position near to the center of spiral element 202. Discharge port 204 connects the fluid pocket formed in the center of the interfitting spiral elements (the high pressure space) with rear chamber 25 via a reed valve 206.

Orbiting scroll 21 is disposed in front chamber 26. Orbiting scroll 21 also comprises a circular end plate 211 and a wrap or involute spiral element 212 affixed to and extending from one side surface of circular end plate 211. Spiral element 212 and spiral element 202 interfit at an angular offset of 180° and a predetermined radial offset. A pair of fluid pockets are thereby defined between spiral elements 202, 212. Orbiting scroll 21 is connected to the drive mechanism and to the rotation preventing/thrust bearing device 22 (both of which are described below). These last two mechanisms effect the orbital motion of orbiting scroll 21 by rotation of drive shaft 14, to thereby compress fluid passing through the compressor unit according to the general principles described above. Each spiral element 202, 212 is provided with a groove 30 formed in its axial end surface along the spiral curve. A seal element 31 is fitted within groove 30. Sealing between the axial end surface of each spiral element and the inner end surface of the opposite end plate is effected by the seal element.

A crank pin or drive pin (not shown) projects axially inwardly from the end surface of disk rotor 141 and is radially offset from the center of drive shaft 14. Circular end plate 211 of orbiting scroll 21 is provided with a tubular boss 213 projecting axially outwardly from the end surface opposite to the side from which spiral element 212 extends. A discoid or short axial bushing 29 is fitted into boss 213, and is rotatably supported therein by a bearing, such as a needle bearing 30. Bushing 29 has a balance weight 291 which is shaped as a portion of a disk or ring and extends radially from busing 29 along a front surface thereof. An eccentric hole (not shown) is formed in bushing 29 radially offset from the center of bushing 29. The drive pin on disk rotor 141 is fitted into this eccentrically disposed hole. Bushing 29 is therefore driven by the revolution of the drive pin and is permitted to rotate by needle bearing 30. The spiral element 212 of orbiting scroll 21 is thus urged against the spiral element 202 of fixed scroll 20 due to the net moment created between the driving point and the point at which the reaction force of the pressurized gas acts, thereby securing the line contacts to effect radial sealing.

Rotation preventing/thrust bearing device 22 is disposed around boss 213 and is comprised of a fixed ring 221 fastened against the inner end surface of front end plate 11, an orbiting ring 222 fastened against the end surface of circular end plate 211 and a plurality of ball elements 223 retained in pairs of opposing holes which are formed through both rings 221, 222. The rotation of orbiting scroll 21 is thus prevented by the interaction of balls 223 with rings 221, 222; and the axial thrust load from orbiting scroll 21 is supported on front end plate 11 through balls 223 and fixed ring 221.

Figure 3:
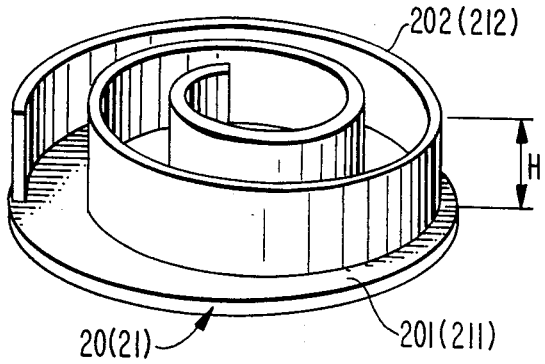
FIG. 3 is a perspective view of a scroll type member according to one embodiment of this invention.
Figure 4:
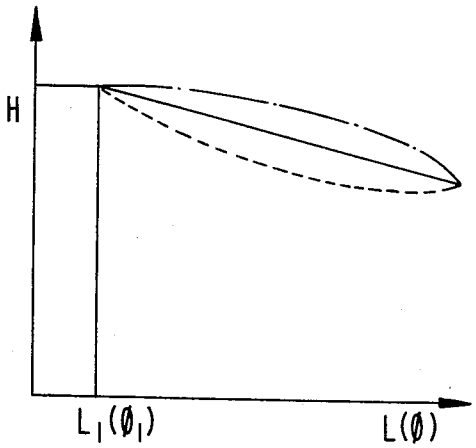
FIGS. 4 and 5 are diagramatic views illustrating various embodiments of height profiles of a spiral element in accordance with the invention.

Referring to FIG. 3, the configuration of a scroll, particularly the spiral element of a scroll according to one embodiment of the invention, is illustrated. As shown in FIGS. 3 and 4, the central portion of each spiral element 202, 212 is made slightly higher than the outer portion thereof. The higher portion of each spiral element 202, 212 extends from the inner end portion to a position $L_1$ (or involute angle $\phi 1$). The position $L_1$ (or involute angle $\phi 1$) is the location of the line contacts between the spiral curved surfaces when the two innermost fluid pockets are just merged into a single fluid pocket at the center of the interfitting spiral elements. The height profile of the remaining outer portion of each spiral element is gradually and continuously reduced from point $L_1$, as represented by the solid line in FIG. 4. Alternatively, the height profile may follow either the dotted line or the dot/dash line in FIG. 4. The varying height of the spiral element can be achieved by the same end milling tool which is used to form the entire scroll member, so that all dimensions, including the height of the spiral element, are achieved by one tool in one fabrication process.

Figure 5:
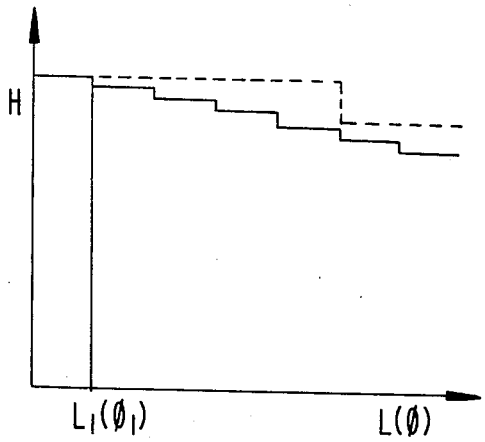

Referring to FIG. 5, an alternative spiral element profile is shown. As illustrated, the height of the spiral element may be reduced from the center in step-like fashion.

When the two scrolls are interfitted at an angular and a radial offset to make a plurality of line contacts between the spiral curved surfaces of the spiral elements, a small axial gap may exist at the outer portions of the spiral elements (from points $L_1$ outward) due to the lower height of these portions. However, the more important sealing of the inner, higher pressure spaces is insured by the taller central portions of the spiral elements. Even if axial slant of the orbiting scroll occurs, the sealing of the central high pressure space is secured by operation of the seal element, and interference between the spiral element and the edge of the opposite end plate is avoided. Also, in a compressor which through manufacturing error lacks parallelism of opposite end plates, sealing of the high pressure space by operation of seal elements 31 still can be secured, and interference between the spiral element and the edge of the opposite end plate, which would cause abnormal wear, can be avoided. End plate parallelism tolerances can therefore be relaxed, yielding a less expensive compressor unit.

This invention has been described in detail in connection with preferred embodiments, but these embodiments are merely for example only, and this invention is not restricted thereto. It will be easily understood by those skilled in the art that other variations and modifications can easily be made within the scope of this invention, which is defined by the appended claims.

We claim:

1. In a scroll type fluid displacement apparatus including a housing, a pair of scrolls within said housing, one of said scrolls fixedly disposed relative to said housing and having an end plate from which a first wrap extends, the other scroll movably disposed for non-rotative orbital movement within the interior of said housing having an end plate from which a second wrap extends, said first and second wraps interfitting at an angular and a radial offset to make a plurality of line contacts to define at least one pair of sealed off fluid pockets, and a driving and rotation-preventing mechanism operatively connected with said other scroll to effect orbital motion of the other scroll while preventing rotation thereof, thus causing the fluid pockets to change in volume, the two innermost fluid pockets eventually merging into a single pocket near the center portions of said wraps, the improvement wherein the center portion of at least one of said wraps is higher than the remaining portion thereof, said center portion extending substantially from the inner end of said wrap outwardly at least to the location of the line contact between the curved surfaces of said wraps when said two innermost fluid pockets are merged into a single fluid pocket.

2. The scroll type fluid displacement apparatus of claim 1 wherein the height of said remaining portion gradually diminishes toward the outer terminal end thereof.

3. The scroll type fluid displacement apparatus of claim 1 wherein the height of said remaining portion diminishes stepwise toward the outer terminal end thereof.

* * * * *